US012710004B1

(12) United States Patent
Mital et al.

(10) Patent No.: US 12,710,004 B1
(45) Date of Patent: Aug. 18, 2026

(54) FILTER REGENERATION PROCESS

(71) Applicant: GM Global Technology Operations LLC, Detroit, MI (US)

(72) Inventors: Rahul Mital, Rochester Hills, MI (US); Bryan D. Axe, Farmington Hills, MI (US); Sarah Funk, Canton, MI (US); Jianwen Li, West Bloomfield, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 0 days.

(21) Appl. No.: 19/098,589

(22) Filed: Apr. 2, 2025

(51) Int. Cl.

| | |
|---|---|
| ***F01N 3/02*** | (2006.01) |
| ***F01N 3/027*** | (2006.01) |
| ***F01N 3/035*** | (2006.01) |
| ***F01N 3/20*** | (2006.01) |

(52) U.S. Cl.
CPC ..... *F01N 3/027* (2013.01); *F01N 3/035* (2013.01); *F01N 3/2013* (2013.01); *F01N 3/2066* (2013.01)

(58) Field of Classification Search
CPC ..... F01N 3/027; F01N 3/035; F01N 3/2013; F01N 3/2066; F01N 3/0814; F01N 3/023; F01N 3/20; F01N 3/2006; F01N 13/009; F01N 9/00; F01N 9/002; F01N 11/00; F01N 2240/16; F01N 2240/18; F01N 2250/02; Y02T 10/12; Y02T 10/40
See application file for complete search history.

(56) References Cited

U.S. PATENT DOCUMENTS

| | | | | |
|---|---|---|---|---|
| 6,988,361 | B2 * | 1/2006 | van Nieuwstadt | F01N 9/002 60/276 |
| 9,321,009 | B2 * | 4/2016 | Wan | B01D 53/58 |
| 9,597,635 | B2 * | 3/2017 | Qi | B01D 53/9481 |
| 10,358,966 | B2 * | 7/2019 | Smith | F02D 41/0295 |
| 10,914,214 | B2 * | 2/2021 | Price | F01N 3/2066 |
| 2013/0111886 | A1 * | 5/2013 | Gonze | F01N 3/2013 60/286 |
| 2014/0112833 | A1 * | 4/2014 | Nakano | B01D 53/9459 422/170 |
| 2019/0234281 | A1 * | 8/2019 | Wiebenga | F01N 13/0093 |
| 2019/0368402 | A1 * | 12/2019 | Barrientos Betancourt | F01N 3/2013 |
| 2020/0291839 | A1 * | 9/2020 | Lambert | F01N 3/0807 |

FOREIGN PATENT DOCUMENTS

DE 102018208958 A1 12/2019

OTHER PUBLICATIONS

Machine Translation DE 10 2018 208 958 (Year: 2026).*
German Office Action for German Application No. 102025118475.5; dated Dec. 5, 2025; 5 pages.

* cited by examiner

*Primary Examiner* — Dapinder Singh
(74) *Attorney, Agent, or Firm* — CANTOR COLBURN LLP

(57) ABSTRACT

A vehicle includes an internal combustion engine. An exhaust system is connected to an exhaust output of the internal combustion engine. The exhaust system includes a passive storage component upstream of an electric heating unit and a selective catalytic reducer and a particulate filter downstream of the electric heating unit. A controller is controllably coupled to the exhaust system and configured to initiate a soot burn of the particulate filter while maintaining the passive storage component within a predetermined temperature range.

20 Claims, 3 Drawing Sheets

FILTER REGENERATION PROCESS

INTRODUCTION

The subject disclosure relates to filter regeneration for exhaust systems in diesel engines, and in particular to a control scheme for operating a diesel engine exhaust system to reduce emissions.

During a combustion cycle of an internal combustion engine (ICE), air/fuel mixtures are provided to cylinders of the ICE. The air/fuel mixtures are compressed and/or ignited and combusted to provide output torque. After combustion, pistons of the ICE force exhaust gases in the cylinders out through exhaust valve openings and into an exhaust system. The exhaust gas emitted from an ICE, particularly a diesel engine, is a heterogeneous mixture that contains gaseous emissions such as carbon monoxide (CO), unburned hydrocarbons, oxides of nitrogen (NOx), and oxides of sulfur (SOX), as well as condensed phase carbonaceous materials (liquids and solids) that constitute soot. Liquids can include water and hydrocarbons, for example.

Exhaust gas treatment systems may employ catalysts in one or more components configured for accomplishing an after-treatment process such as reducing NOx to produce more tolerable exhaust constituents of nitrogen (N2) and water (H2O). One type of exhaust treatment technology for reducing NOx emissions is a selective catalytic reduction (SCR) device, which generally includes a substrate or support with a catalytic composition disposed thereon. Passing exhaust over the catalyst converts certain or all exhaust constituents into desired compounds, such as non-regulated exhaust gas components. A reductant is typically sprayed into hot exhaust gases upstream of the SCR, decomposed into ammonia, and absorbed by the SCR.

The ammonia reduces the NOx to nitrogen and water in the presence of the SCR catalyst.

A selective catalytic reduction filter device (SCRF) includes the SCR catalytic composition applied to a porous filter substrate. Soot accumulating in a SCRF can be periodically oxidized, combusted, or otherwise removed during high temperature regeneration events referred to as soot burns.

Some systems use a combination of passive storage elements (e.g. adsorbers) and active removal elements (e.g. selective catalytic reduction (SCR) components). Typically in such systems the passive storage element(s) store compounds like Nitrogen Oxide (NOx) from the exhaust during a cold start. Once the engine has warmed sufficiently, the active removal elements begin filtering. In addition, due to the increased temperature, the passive storage elements release the stored compounds into the exhaust. As the passive storage elements are upstream of the active removal elements, the compounds released from the passage storage elements are filtered and removed from the exhaust gas by the active removal elements.

In order to achieve the temperatures required for an efficient soot burn, engine controls raise the temperature of the exhaust, which in turn raises the temperature of the active removal elements. During the soot burn, the active removal elements are not functioning. In addition, due to the high temperatures of the exhaust, the passive storage elements do not store the compounds. As a result, the compounds pass through the removal systems and are released from the engine.

Accordingly, it is desirable to provide a process for storing and removing compounds from an exhaust gas during a soot burn.

SUMMARY

In one exemplary embodiment a vehicle including an internal combustion engine, wherein operation of the internal combustion engine generates exhaust gasses. An exhaust system is connected to an exhaust output of the internal combustion engine. The exhaust system is configured to receive the exhaust gasses. The exhaust system includes a passive storage component. The passive storage component is upstream of an electric heating unit. The exhaust system further includes a selective catalytic reducer and a particulate filter. The selective catalytic reducer and the particulate filter are downstream of the electric heating unit. A controller is controllably coupled to the exhaust system. The controller is configured to initiate a soot burn of the particulate filter while maintaining a temperature of the passive storage component within a predetermined temperature range.

In addition to one or more of the features described herein the passive storage component is a passive NOx adsorber.

In addition to one or more of the features described herein the predetermined temperature range includes lower bound defined by a minimum temperature at which the particulate filter can refresh via a soot burn and an upper bound defined by a maximum temperature at which the passive storage component can store particulate.

In addition to one or more of the features described herein the predetermined temperature range includes lower bound of 500 degrees centigrade and an upper bound of 550 degrees centigrade.

In addition to one or more of the features described herein the particulate filter is a selective catalytic reactor filter.

In addition to one or more of the features described herein the particulate filter is a catalyzed diesel particulate filter.

In addition to one or more of the features described herein the controller is configured to maintain the soot burn for a predetermined time period.

In addition to one or more of the features described herein the controller is configured to end the soot burn in response to a backpressure in an exhaust flow falling below a threshold.

In addition to one or more of the features described herein initiating the soot burn of the particulate filter while maintaining the passive storage component within a predetermined temperature range occurs during operation of the vehicle.

In addition to one or more of the features described herein the controller is configured to initiate the soot burn responsive to a backpressure of an exhaust flow exceeding a predetermined threshold.

In addition to one or more of the features described herein the controller is configured to initiate the soot burn responsive to a period of time since a previous soot burn exceeding a predetermined threshold.

In another exemplary embodiment a method for refreshing a particulate filter of a vehicle exhaust system includes initiating a soot burn of a particulate filter while maintaining a passive storage component within a predetermined temperature range using a controller. The vehicle includes an internal combustion engine and an exhaust system connected to an exhaust output of the internal combustion engine. The exhaust system including the passive storage component upstream of an electric heating unit and a selective catalytic reducer and the particulate filter downstream of the electric heating unit and the controller being controllably coupled to the exhaust system.

In addition to one or more of the features described herein the passive storage component is a passive NOx adsorber.

In addition to one or more of the features described herein the predetermined temperature range includes lower bound defined by a minimum temperature at which the particulate filter can refresh via a soot burn and an upper bound defined by a maximum temperature at which the passive storage component can store particulate.

In addition to one or more of the features described herein the predetermined temperature range includes lower bound of 500 degrees centigrade and an upper bound of 550 degrees centigrade.

In addition to one or more of the features described herein the particulate filter is one of a selective catalytic reactor filter and a catalyzed diesel particulate filter.

In addition to one or more of the features described herein the controller is configured to maintain the soot burn for a predetermined time period.

In addition to one or more of the features described herein the controller is configured to end the soot burn in response to a backpressure in an exhaust flow falling below a threshold.

In addition to one or more of the features described herein initiating the soot burn of the particulate filter while maintaining the passive storage component within a predetermined temperature range occurs during operation of the vehicle.

In addition to one or more of the features described herein the controller is configured to initiate the soot burn responsive to one of a backpressure of an exhaust flow exceeding a predetermined threshold and a period of time since a previous soot burn exceeding a predetermined threshold.

The above features and advantages, and other features and advantages of the disclosure are readily apparent from the following detailed description when taken in connection with the accompanying drawings.

BRIEF DESCRIPTION OF THE DRAWINGS

Other features, advantages and details appear, by way of example only, in the following detailed description, the detailed description referring to the drawings in which:

FIG. 4 is a process for regenerating a diesel particulate filter without significantly reducing a Nitrogen Oxide (NOx) pass through.

DETAILED DESCRIPTION

Figure 1:
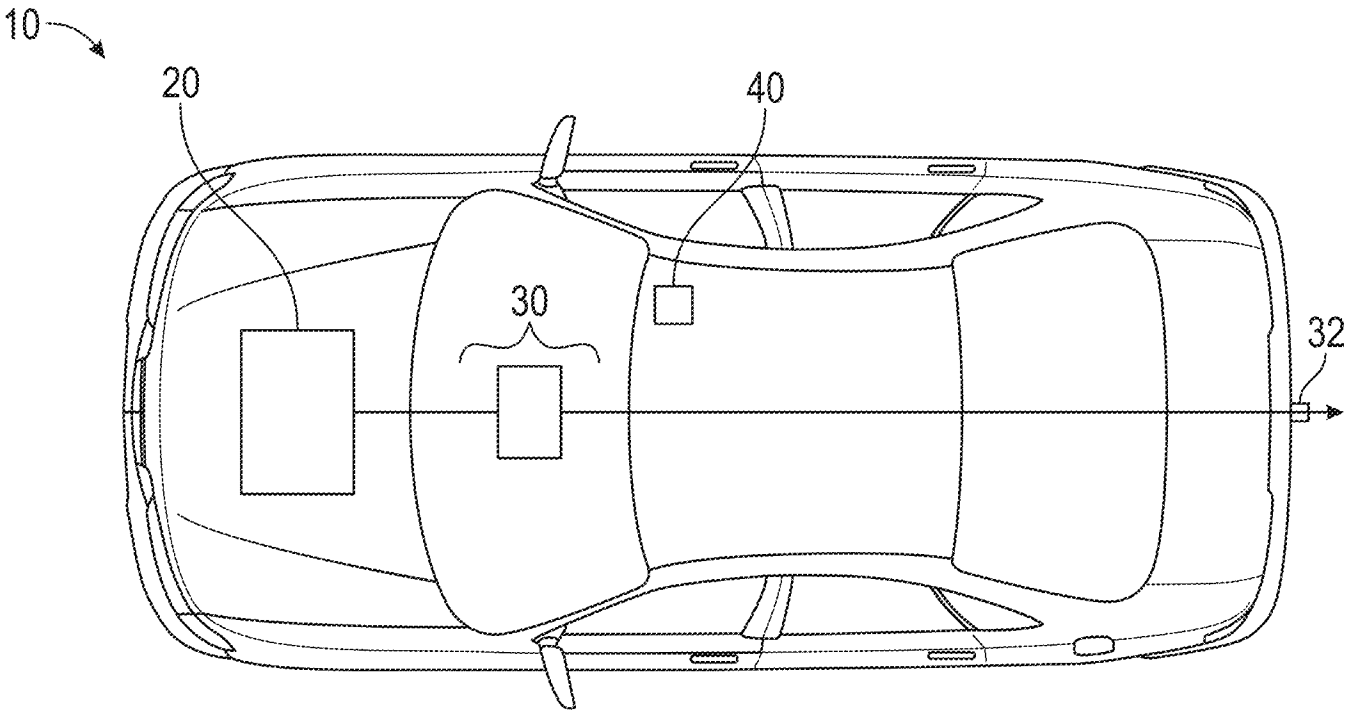
FIG. 1 is a schematic representation of a vehicle.

The following description is merely exemplary in nature and is not intended to limit the present disclosure, its application or uses. It should be understood that throughout the drawings, corresponding reference numerals indicate like or corresponding parts and features.

As used herein, the term controller refers to a system including at least a processor and a memory, with the system being configured to perform or cause to be performed at least one operation. The system can be a dedicated controller including a single purpose processor and memory, a general control including one or more modules for performing the operation, a distributed system including multiple controllers in communication with each other and configured to control the operation, or any similar system.

In one general implementation of the systems and processes described herein, an ICE vehicle addresses vehicle emissions during a soot burn by using an electric heating unit upstream of a selective catalytic reactor (SCR) and a selective catalytic reactor filter (SCRF) to raise the SCR and the SCRF to desired operating temperatures during conventional operations. The electric heating unit can then be used to supplement engine controls to raise the SCRF to a high enough temperature to initiate a soot burn, without raising the temperature of the passive storage element. The vehicle controls actively control the electric heating unit to maintain the exhaust system in a temperature range that is high enough for soot burn to continue, but at the same time is low enough for the passive storage element to store incoming contaminants.

In accordance with an exemplary embodiment, FIG. 1 illustrates a vehicle 10 including an internal combustion engine (ICE) 20, such as a diesel engine. The ICE 20 generates exhaust gasses, and the exhaust gasses are output through an exhaust system 30 and an exhaust pipe 32, after which the gasses are emitted from the vehicle 10. The exhaust system 30 includes passive storage elements and active filter elements that store and/or remove particulate and other undesirable compounds from the exhaust gasses before the exhaust gasses are passed through the exhaust pipe 32.

A controller 40 is in communication with the ICE 20 and the exhaust system 30 and controls operations of the ICE 20 and the exhaust system 30. The controller may be in direct control communication with one or more components of each of the ICE 20 and/or the exhaust system 30, indirect control communication, or any other communication arrangement whereby the controller 20 outputs control signals and/or control instructions that are implemented by components of the ICE 20 and/or the exhaust system 30. It is further appreciated that while the ICE 20 and the exhaust system 30 are described herein as distinct systems, the constituent components of the ICE 20 and the exhaust system 320 may overlap, may be included in both systems, or may be arranged any other conventional arrangement.

Figure 2:
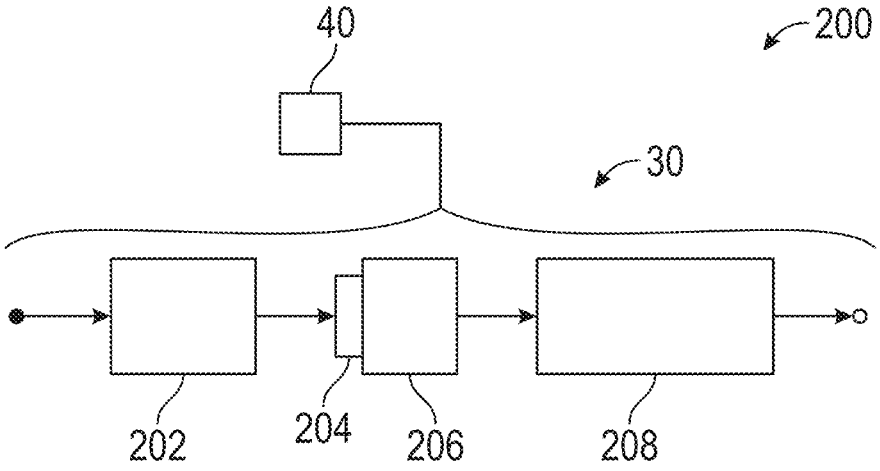
FIG. 2 is a schematic representation of a diesel exhaust system of the vehicle of FIG. 1.

With continued reference to FIG. 1, FIG. 2 illustrates an example portion 200 of the exhaust system 30. In a practical implementation, the portion 200 may be positioned at a beginning or end of a flow through the exhaust system 30, or be positioned upstream of some portions and downstream of other portions of the exhaust system 30.

The portion 200 includes a passive NOx adsorber (PNA 202) upstream of a heat source (heater 204). The heater 204 is upstream of a selective catalytic reducer (SCR 206) and a particulate filter 208. In some examples the heater 204 is an electric heater. In other examples, the heater 204 can be a gas burning heater. The particulate filter 208 is a regenerative filter configured to trap one or more compounds from exhaust flowing through the exhaust system 30. After a sufficient magnitude of compound(s) have been removed from the gas and stored in the particulate filter 208, the particulate filter 208 can be regenerated by initiating a soot burn, after which the particulate filter 208 is clean and can continue to trap particulates. In one example the particulate filter 208 is a selective catalytic reducer on filter (SCRF). In another example, the particulate filter is a diesel particulate filter (DPF).

Figure 3:
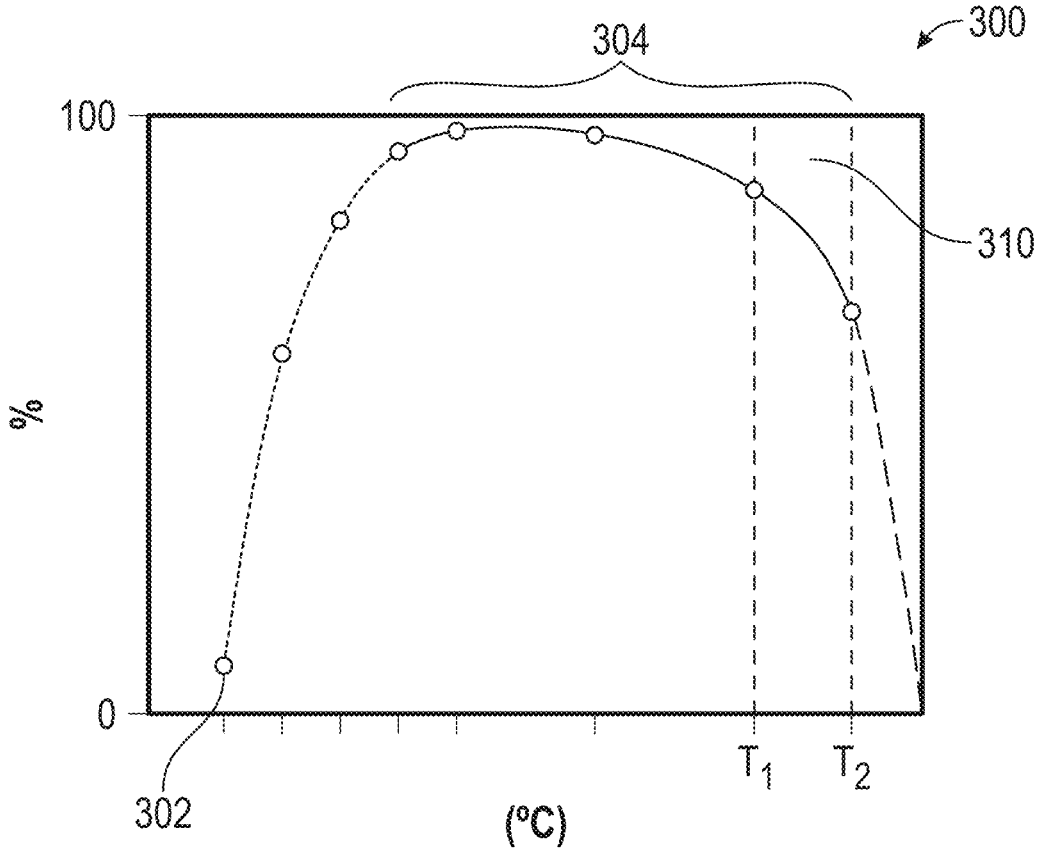
FIG. 3. is a graph illustrating an ability of a passive adsorber to remove NOx from an exhaust stream.
Figure 4:
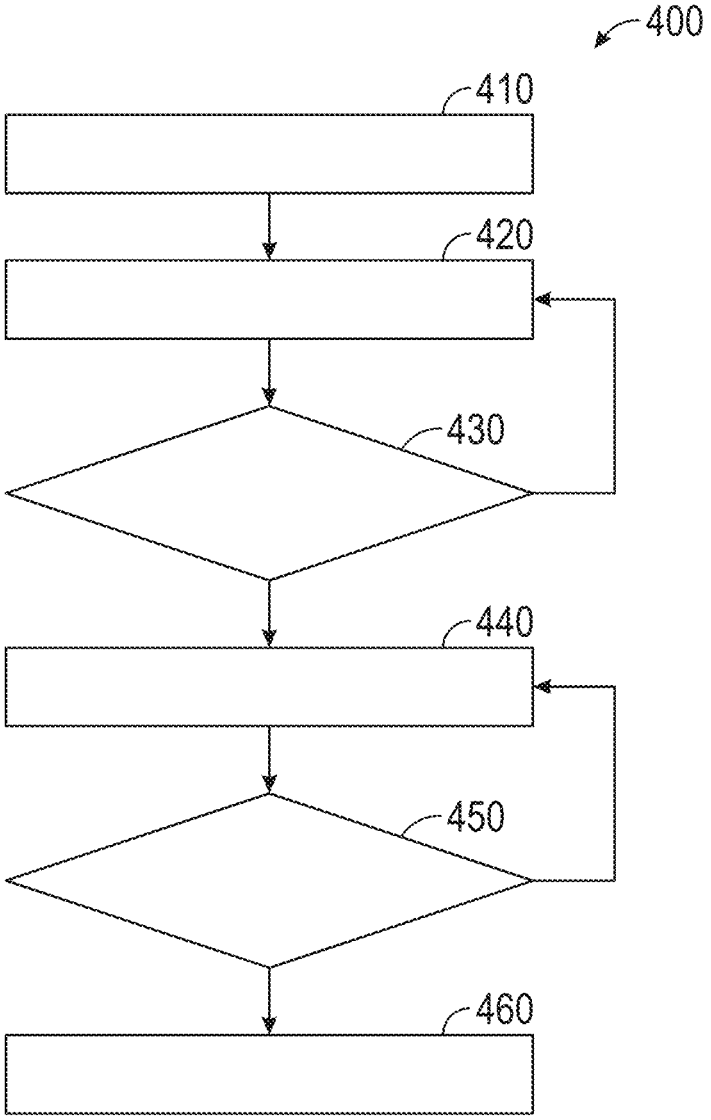

The PNA 202 passively removes oxides of nitrogen (e.g. NOx) while below a certain temperature with an efficiency of the passive removal (conversion percent) being dependent on the temperature. With continued reference to FIGS. 1 and 2, FIG. 3 illustrates a chart 300 demonstrating a conversion percent with respect to temperature of the PNA 202, with a temperature in degrees C. as the horizontal axis, and a conversion percentage as the vertical axis. Initially (at data point 302), the conversion percent is low, but above 0. Increased temperature quickly raises the conversion percentage until a plateau 304 is reached. The plateau 304 extends across a temperature band after which the conversion percent begins to drop, with increasing temperatures quickly resulting in no, or nearly no, conversion.

At the tail edge of the plateau 304 is a temperature window 310 defined by a lower bound (T1) and an upper bound (T2). The lower bound T1 is a minimum temperature of exhaust gasses at which the electric heater 204 can sufficiently heat the exhaust downstream of the PNA 202 such that the particulate filter 208 can operate a soot burn and regenerate, while the upper bound T2 is a maximum temperature at which the SCR 206 is able to effectively convert NOx. Absent the electric heater, 204, the minimum temperature of the exhaust gasses to initiate a soot burn is higher than the maximum temperature at which the SCR 206 is able to effectively Convert NOx. In one example, the lower bound T1 of the window 310 is 500 degrees C., while the upper bound T2 of the window 310 is 550 degrees C. In other examples, such as those utilizing alternative structures for the NOx adsorber, or alternative regeneration particulate filters, the upper bound T2 and/or the lower bound T1 can deviate from the exemplary 500-550 degrees C. range.

With continued reference to FIGS. 1-3, FIG. 4 illustrates a process 400 implemented by the controller 20 for performing a soot burn while operating a passive storage element (e.g., the PNA 202). Initially, the controller 20 detects a trigger condition and initiates the particulate burn in an initiate particulate burn step 410. In some cases the trigger condition can be a backpressure in the exhaust flow resulting from an accumulation of particulate within the regenerating particulate filter 208. In other examples, the trigger condition can be an elapsed period of time since a previous particulate burn. In yet other cases the trigger condition can be a combination of the two.

Upon initiation, the process 400 controls the engine parameters to increase the exhaust gas temperatures and activates the electronic heating component in an activate EHC step 420. During the activate EHC step 420, the electronic heating component 204 heats the exhaust system 30 and raises the temperature of the SCR 206 and the particulate filter 208.

The process 400 monitors a temperature of the particulate filter 208 to determine if particulate filter 208 has reached at least a target temperature in a target temperature reached check 430. The target temperature is the lower bound (T1) of the temperature window 310. When the target temperature has not yet been reached, the process 400 returns to the activate EHC step 420 and continues applying heat from the electronic heating component 204.

When the check 430 determines that the target temperature has been reached, the process 400 maintains the temperature within the target window 310 by controlling engine parameters and using the EHC 204 in a maintain burn in target window step 440.

As the burn proceeds, the process 400 monitors to determine if the burn has been completed in a burn complete check 450. Whether the burn is complete can be determined through either backpressure monitoring (when a backpressure falls below a predetermined threshold), when a duration of the burn has been exceeded or a combination of the two. If the burn has not been completed, the process 400 returns to the maintain burn in temperature window step 440.

When the burn has been completed, the process 400 ends the burn, and the exhaust system 30 returns to normal operations in an end burn step 460.

The terms "a" and "an" do not denote a limitation of quantity, but rather denote the presence of at least one of the referenced item. The term "or" means "and/or" unless clearly indicated otherwise by context. Reference throughout the specification to "an aspect", means that a particular element (e.g., feature, structure, step, or characteristic) described in connection with the aspect is included in at least one aspect described herein, and may or may not be present in other aspects. In addition, it is to be understood that the described elements may be combined in any suitable manner in the various aspects.

When an element such as a layer, film, region, or substrate is referred to as being "on" another element, it can be directly on the other element or intervening elements may also be present. In contrast, when an element is referred to as being "directly on" another element, there are no intervening elements present.

Unless specified to the contrary herein, all test standards are the most recent standard in effect as of the filing date of this application, or, if priority is claimed, the filing date of the earliest priority application in which the test standard appears.

Unless defined otherwise, technical and scientific terms used herein have the same meaning as is commonly understood by one of skill in the art to which this disclosure belongs.

While the above disclosure has been described with reference to exemplary embodiments, it will be understood by those skilled in the art that various changes may be made and equivalents may be substituted for elements thereof without departing from its scope. In addition, many modifications may be made to adapt a particular situation or material to the teachings of the disclosure without departing from the essential scope thereof. Therefore, it is intended that the present disclosure not be limited to the particular embodiments disclosed, but will include all embodiments falling within the scope thereof.

What is claimed is:

1. A vehicle comprising:

an internal combustion engine, wherein operation of the internal combustion engine generates exhaust gasses;

an exhaust system connected to an exhaust output of the internal combustion engine, wherein the exhaust system is configured to receive the exhaust gasses, the exhaust system including a passive storage component, wherein the passive storage component is upstream of an electric heating unit, and the exhaust system further including a selective catalytic reducer and a particulate filter, wherein the selective catalytic reducer and the particulate filter are downstream of the electric heating unit; and a controller controllably coupled to the exhaust system, wherein the controller is configured to initiate a soot burn of the particulate filter while maintaining a temperature of the passive storage component within a predetermined temperature range, and wherein the controller is configured to maintain the soot burn for a predetermined time period, the predetermined time period being a length of time where the length is determined prior to initiating the soot burn.

2. The vehicle of claim 1, wherein the passive storage component is a passive NOx adsorber.

3. The vehicle of claim 1, wherein the predetermined temperature range includes lower bound defined by a minimum temperature at which the particulate filter can regenerate via a soot burn and an upper bound defined by a maximum temperature at which the passive storage component can store particulate.

4. The vehicle of claim 1, wherein the predetermined temperature range includes lower bound of 500 degrees centigrade and an upper bound of 550 degrees centigrade.

5. The vehicle of claim 1, wherein the particulate filter is a selective catalytic reduction filter.

6. The vehicle of claim 1, wherein the particulate filter is a catalyzed diesel particulate filter.

7. The vehicle of claim 1, wherein the controller is configured to end the soot burn in response to a backpressure in an exhaust flow falling below a threshold and the predetermined time period elapsing.

8. The vehicle of claim 1, wherein initiating the soot burn of the particulate filter while maintaining the passive storage component within a predetermined temperature range occurs during operation of the vehicle.

9. The vehicle of claim 1, wherein the controller is configured to initiate the soot burn responsive to a backpressure of an exhaust flow exceeding a predetermined threshold.

10. The vehicle of claim 1, wherein the controller is configured to initiate the soot burn responsive to a period of time since a previous soot burn exceeding a predetermined threshold.

11. A method for refreshing a particulate filter of an exhaust system of a vehicle, the method comprising:

initiating a soot burn of a particulate filter while maintaining a passive storage component within a predetermined temperature range using a controller;

maintaining the soot burn of the particulate filter until after a predetermined time period has elapsed, the predetermined time period being a length of time where the length is determined prior to initiating the soot burn; and wherein the vehicle includes an internal combustion engine, an exhaust system connected to an exhaust output of the internal combustion engine, the exhaust system including the passive storage component upstream of an electric heating unit and a selective catalytic reducer and the particulate filter downstream of the electric heating unit and the controller being controllably coupled to the exhaust system.

12. The method of claim 11, wherein the passive storage component is a passive NOx adsorber.

13. The method of claim 11, wherein the predetermined temperature range includes lower bound defined by a minimum temperature at which the particulate filter can refresh via a soot burn and an upper bound defined by a maximum temperature at which the passive storage component can store particulate.

14. The method of claim 11, wherein the predetermined temperature range includes lower bound of 500 degrees centigrade and an upper bound of 550 degrees centigrade.

15. The method of claim 11, wherein the particulate filter is one of a selective catalytic reactor filter and a catalyzed diesel particulate filter.

16. The method of claim 11, wherein the controller is configured to maintain the soot burn for a predetermined time period.

17. The method of claim 11, wherein the controller is configured to end the soot burn in response to a backpressure in an exhaust flow falling below a threshold.

18. The method of claim 11, wherein initiating the soot burn of the particulate filter while maintaining the passive storage component within a predetermined temperature range occurs during operation of the vehicle.

19. The method of claim 11, wherein the controller is configured to initiate the soot burn responsive to one of a backpressure of an exhaust flow exceeding a predetermined threshold and a period of time since a previous soot burn exceeding a predetermined threshold.

20. The method of claim 11, further comprising ending the soot burn in response to the backpressure in an exhaust flow falling below a threshold and the predetermined time period elapsing.

* * * * *